US010075801B2

(12) United States Patent
Sako et al.

(10) Patent No.: US 10,075,801 B2
(45) Date of Patent: Sep. 11, 2018

(54) INFORMATION PROCESSING SYSTEM AND STORAGE MEDIUM

(71) Applicant: SONY CORPORATION, Tokyo (JP)

(72) Inventors: Yoichiro Sako, Tokyo (JP); Kohei Asada, Kanagawa (JP); Kazuyuki Sakoda, Chiba (JP); Katsuhisa Aratani, Kanagawa (JP); Mitsuru Takehara, Tokyo (JP); Takatoshi Nakamura, Kanagawa (JP); Kazuhiro Watanabe, Tokyo (JP); Akira Tange, Tokyo (JP); Hiroyuki Hanaya, Kanagawa (JP); Yuki Koga, Tokyo (JP); Tomoya Onuma, Shizuoka (JP)

(73) Assignee: SONY CORPORATION, Tokyo (JP)

( * ) Notice: Subject to any disclaimer, the term of this patent is extended or adjusted under 35 U.S.C. 154(b) by 35 days.

(21) Appl. No.: 14/413,024

(22) PCT Filed: Apr. 19, 2013

(86) PCT No.: PCT/JP2013/061647
§ 371 (c)(1),
(2) Date: Jan. 6, 2015

(87) PCT Pub. No.: WO2014/010290
PCT Pub. Date: Jan. 16, 2014

(65) Prior Publication Data

US 2015/0208191 A1 Jul. 23, 2015

(30) Foreign Application Priority Data

Jul. 13, 2012 (JP) ..... 2012-157722

(51) Int. Cl.
*H04R 3/00* (2006.01)
*H04R 5/02* (2006.01)
(Continued)

(52) U.S. Cl.
CPC ..... *H04S 7/302* (2013.01); *H04R 1/403* (2013.01); *H04R 3/005* (2013.01); *H04R 3/12* (2013.01);
(Continued)

(58) Field of Classification Search
CPC ..... H04S 7/301; H04S 7/303; H04S 7/302; H04S 7/30; H04S 2420/05
(Continued)

(56) References Cited

U.S. PATENT DOCUMENTS 6,738,382 B1 * 5/2004 West ..... H04L 12/2859 370/401
8,082,051 B2 * 12/2011 Mihelich ..... H04S 7/307 381/303
(Continued)

FOREIGN PATENT DOCUMENTS

EP 2 114 073 A2 11/2009
JP 64-7100 A 1/1989
(Continued)

OTHER PUBLICATIONS

U.S. Appl. No. 14/404,733, filed Dec. 1, 2014, Sako, et al.
(Continued)

*Primary Examiner* — George C Monikang
(74) *Attorney, Agent, or Firm* — Oblon, McClelland, Maier & Neustadt, L.L.P.

(57) ABSTRACT

An information processing system including a recognizing unit configured to recognize a given target on the basis of signals detected by a plurality of sensors arranged around a specific user, an identifying unit configured to identify the given target recognized by the recognizing unit, an estimating unit configured to estimate a position of the specific user in accordance with the a signal detected by any one of the plurality of sensors, and a signal processing unit configured
(Continued)

to process signals acquired from sensors around the given target identified by the identifying unit in a manner that, when output from a plurality of actuators arranged around the specific user, the signals are localized near the position of the specific user estimated by the estimating unit.

14 Claims, 13 Drawing Sheets

(51) Int. Cl.

| | |
|---|---|
| ***H04S 7/00*** | (2006.01) |
| ***H04R 1/40*** | (2006.01) |
| ***H04R 3/12*** | (2006.01) |
| *H04R 5/027* | (2006.01) |
| *G10L 21/0216* | (2013.01) |

(52) U.S. Cl.
CPC .... *G10L 2021/02166* (2013.01); *H04R 1/406* (2013.01); *H04R 5/027* (2013.01); *H04R 2201/405* (2013.01); *H04R 2420/07* (2013.01); *H04R 2430/23* (2013.01); *H04S 2420/13* (2013.01)

(58) Field of Classification Search
USPC ..... 381/300, 303, 92, 122, 59; 379/93.03, 379/93.21
See application file for complete search history.

(56) References Cited

U.S. PATENT DOCUMENTS

2004/0028202 A1* 2/2004 Lim ..... H04M 1/247 379/202.01
2007/0025538 A1* 2/2007 Jarske ..... H04M 3/56 379/202.01
2009/0055170 A1* 2/2009 Nagahama ..... G10L 15/20 704/226
2009/0079813 A1 3/2009 Hildreth
2011/0002469 A1* 1/2011 Ojala ..... H04S 7/30 381/22
2011/0038489 A1* 2/2011 Visser ..... G01S 3/8006 381/92
2011/0050840 A1 3/2011 Ryu et al.
2011/0135125 A1* 6/2011 Zhan ..... H04R 1/403 381/303
2011/0317041 A1* 12/2011 Zurek ..... H04R 1/406 348/240.99
2012/0327115 A1* 12/2012 Chhetri ..... H04R 3/005 345/633
2013/0083948 A1* 4/2013 Schmidt ..... H04R 5/02 381/303

FOREIGN PATENT DOCUMENTS

| | | | |
|---|---|---|---|
| JP | 9-261351 | A | 10/1997 |
| JP | 2006-279565 | A | 10/2006 |
| JP | 2008-227773 | A | 9/2008 |
| JP | 2008-543137 | A | 11/2008 |
| JP | 2010-13041 | | 6/2010 |
| JP | 2010-130411 | A | 6/2010 |

OTHER PUBLICATIONS

International Search Report dated Jun. 4, 2013 in PCT/JP2013/061647.
Extended European Search Report dated Feb. 17, 2016 in Patent Application No. 13817541.9.
Combined Chinese Office Action and Search Report dated Mar. 14, 2016 in Patent Application No. 201380036179.X (with English language translation).

* cited by examiner

INFORMATION PROCESSING SYSTEM AND STORAGE MEDIUM

TECHNICAL FIELD

The present invention relates to an information processing system and a storage medium.

BACKGROUND ART

In recent years, various technologies have been proposed in data communication fields. For example, Patent Literature 1 below proposes technology related to a Machine-to-Machine (M2M) solution. To be specific, the remote management system written in Patent Literature 1 uses the Internet protocol (IP) multimedia subsystem (IMS) platform (IS), and through disclosure of presence information by a device or instant messaging between a user and a device, an interaction between an authorized user client (UC) and a device client is achieved.

On the other hand, in acoustic technology fields, various types of array speakers that can emit acoustic beams are being developed. For example, Patent Literature 2 below describes array speakers in which a plurality of speakers forming a common wave front are attached to a cabinet and which control amounts of delay and levels of the sounds given out from the respective speakers. Further, Patent Literature 2 below describes that array microphones having the same principle are being developed. The array microphones can voluntarily set the sound acquisition point by adjusting the levels and amounts of delay of output signals of the respective microphones, and thus are capable of acquiring the sound more effectively.

CITATION LIST

Patent Literature

Patent Literature 1: JP 2008-543137T
Patent Literature 2: JP 2006-279565A

SUMMARY OF INVENTION

Technical Problem

However, Patent Literature 1 and Patent Literature 2 described above do not mention anything about technology or a communication method that is understood as means for achieving an augmentation of a user's body by placing many image sensors, microphones, speakers, and the like over a large area.

Accordingly, the present disclosure proposes an information processing system and a storage medium which are novel and improved, and which are capable of causing the space surrounding the user to cooperate with another space.

Solution to Problem

According to the present disclosure, there is provided an information processing system including a recognizing unit configured to recognize a given target on the basis of signals detected by a plurality of sensors arranged around a specific user, an identifying unit configured to identify the given target recognized by the recognizing unit, an estimating unit configured to estimate a position of the specific user in accordance with the a signal detected by any one of the plurality of sensors, and a signal processing unit configured to process signals acquired from sensors around the given target identified by the identifying unit in a manner that, when output from a plurality of actuators arranged around the specific user, the signals are localized near the position of the specific user estimated by the estimating unit.

According to the present disclosure, there is provided an information processing system including a recognizing unit configured to recognize a given target on the basis of signals detected by sensors around a specific user, an identifying unit configured to identify the given target recognized by the recognizing unit, and a signal processing unit configured to generate signals to be output from actuators around the specific user on the basis of signals acquired by a plurality of sensors arranged around the given target identified by the identifying unit.

According to the present disclosure, there is provided a storage medium having a program stored therein, the program being for causing a computer to function as a recognizing unit configured to recognize a given target on the basis of signals detected by a plurality of sensors arranged around a specific user, an identifying unit configured to identify the given target recognized by the recognizing unit, an estimating unit configured to estimate a position of the specific user in accordance with the a signal detected by any one of the plurality of sensors, and a signal processing unit configured to process signals acquired from sensors around the given target identified by the identifying unit in a manner that, when output from a plurality of actuators arranged around the specific user, the signals are localized near the position of the specific user estimated by the estimating unit.

According to the present disclosure, there is provided a storage medium having a program stored therein, the program being for causing a computer to function as a recognizing unit configured to recognize a given target on the basis of signals detected by sensors around a specific user, an identifying unit configured to identify the given target recognized by the recognizing unit, and a signal processing unit configured to generate signals to be output from actuators around the specific user on the basis of signals acquired by a plurality of sensors arranged around the given target identified by the identifying unit.

Advantageous Effects of Invention

According to the present disclosure as described above, a space surrounding a user can be caused to cooperate with another space.

DESCRIPTION OF EMBODIMENTS

Hereinafter, preferred embodiments of the present disclosure will be described in detail with reference to the appended drawings. Note that, in this specification and the drawings, elements that have substantially the same function and structure are denoted with the same reference signs, and repeated explanation is omitted.

The description will be given in the following order.

1. Outline of acoustic system according to embodiment of present disclosure
2. Basic configuration
2-1. System configuration
2-2. Signal processing apparatus
2-3. Management server
3. Operation process
3-1. Basic process
3-2. Command recognition process
3-3. Sound acquisition process
3-4. Sound field reproduction process
4. Supplement
5. Conclusion <1. Outline of Acoustic System According to Embodiment of Present Disclosure>

Figure 1:
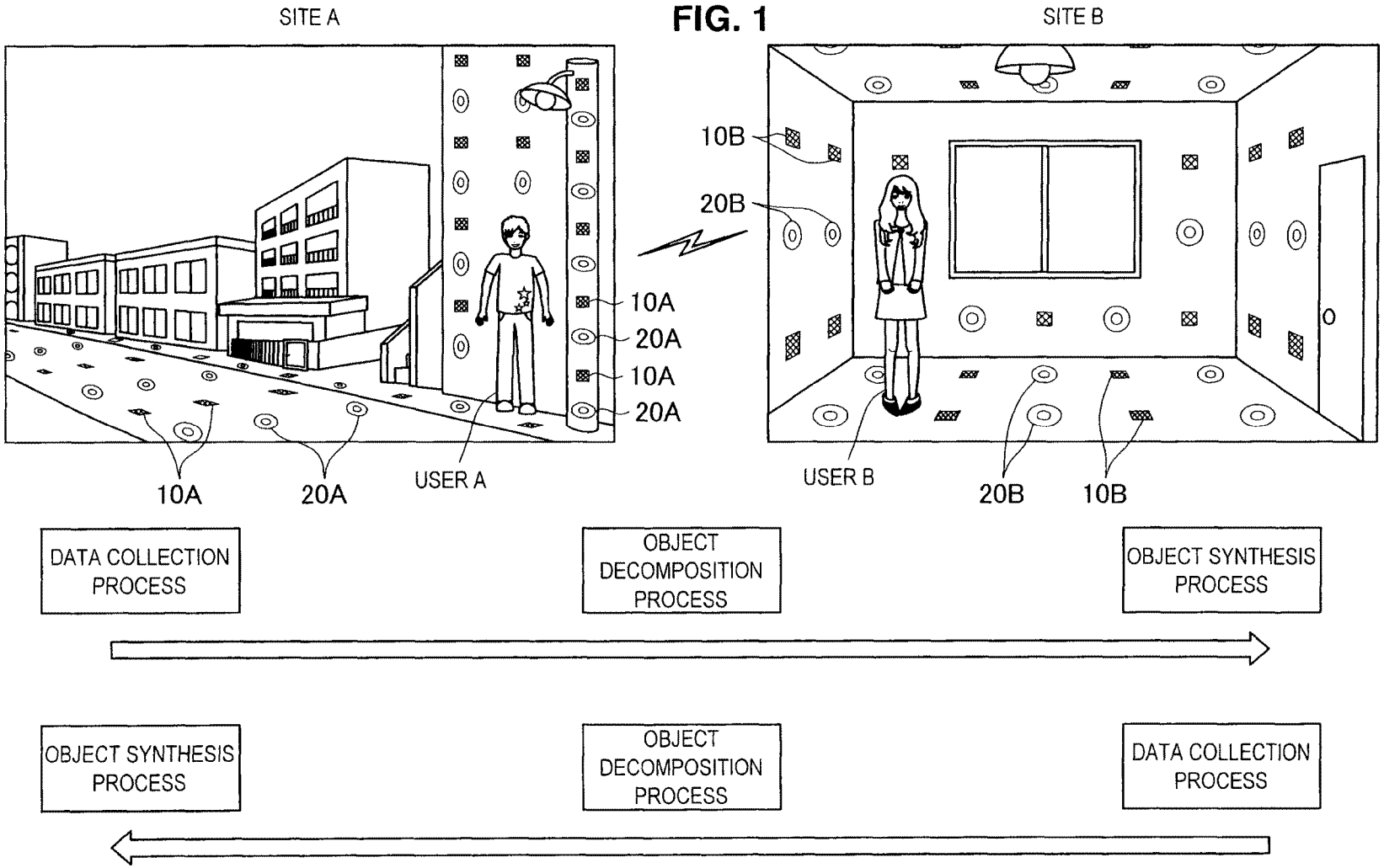
FIG. 1 is a diagram illustrating an outline of an acoustic system according to an embodiment of the present disclosure.

First, with reference to FIG. 1, an outline of an acoustic system (information processing system) according to an embodiment of the present disclosure will be described. FIG. 1 is a diagram illustrating an outline of an acoustic system according to an embodiment of the present disclosure. As shown in FIG. 1, in the acoustic system according to the present embodiment, let us assume the situation in which a large number of sensors and actuators such as microphones 10, image sensors (not shown), and speakers 20 are arranged everywhere in the world such as rooms, houses, buildings, outdoor sites, regions, and countries.

In the example shown in FIG. 1, on a road or the like in an outdoor area "site A" at which a user A is currently located, a plurality of microphones 10A are arranged as examples of the plurality of sensors and a plurality of speakers 20A are arranged as examples of the plurality of actuators. Further, in an indoor area "site B" at which a user B is currently located, a plurality of microphones 10B and a plurality of speakers 20B are arranged on the walls, the floor, the ceiling, and the like. Note that, in the sites A and B, motion sensors and image sensors (which are not shown) may further be arranged as examples of the sensors.

Here, the site A and the site B are connectable to each other through a network, and the signals output from and input to the respective microphones and the respective speakers of the site A and the signals output from and input to the respective microphones and the respective speakers of the site B are transmitted and received between the sites A and B.

In this way, the acoustic system according to the present embodiment reproduces in real time a voice or an image corresponding to a given target (person, place, building, or the like) through a plurality of speakers and a plurality of displays arranged around the user. Further, the acoustic system according to the present embodiment can reproduce around the user in real time the voice of the user that has been acquired by a plurality of microphones arranged around the user. In this way, the acoustic system according to the present embodiment can cause a space surrounding a user to cooperate with another space.

Further, using the microphones 10, the speakers 20, the image sensors, and the like arranged everywhere, indoor sites and outdoor sites, it becomes possible to substantially augment over a large area the body such as the mouth, eyes, ears of the user, and to achieve a new communication method.

In addition, since microphones and image sensors are arranged everywhere in the acoustic system according to the present embodiment, the user does not have to carry a smartphone or a mobile phone terminal. The user specifies a given target using a voice or a gesture, and can establish connection with a space surrounding the given target. Hereinafter, there will be briefly described the application of the acoustic system according to the present embodiment in the case where the user A located at the site A wants to have a conversation with the user B located at the site B.

(Data Collection Process)

At the site A, a data collection process is continuously performed through the plurality of microphones 10A, the plurality image sensors (not shown), the plurality of human sensors (not shown), and the like. Specifically, the acoustic system according to the present embodiment collects voices acquired by the microphones 10A, captured images obtained by the image sensors, or detection results of the human sensors, and estimates the user's position on the basis of the collected information.

Further, the acoustic system according to the present embodiment may select a microphone group arranged at the position at which the user's voice can be sufficiently acquired on the basis of position information of the plurality of microphones 10A which are registered in advance and the user's estimated position. Further, the acoustic system according to the present embodiment performs a microphone array process of a stream group of audio signals acquired by the selected microphones. In particular, the acoustic system according to the present embodiment may perform a delay-and-sum array in which a sound acquisition point is focused on the user A's mouth and can form super directivity of an array microphone. Thus, faint vocalizations such as the user A's muttering can be also acquired.

Further, the acoustic system according to the present embodiment recognizes a command on the basis of the user A's acquired voice, and executes an operation process according to the command. For example, when the user A located at the site A says "I'd like to speak with B," the "call origination request to the user B" is recognized as a command. In this case, the acoustic system according to the present embodiment identifies the current position of the user B, and causes the site B at which the user B is currently located to be connected with the site A at which the user A is currently located. Through this operation, the user A can speak on the telephone with the user B.

(Object Decomposition Process)

An object decomposition process such as sound source separation (separation of a noise component around the user A, a conversation of a person around the user A, and the like), dereverberation, and a noise/echo process is performed on audio signals (stream data) acquired by the plurality of microphones at the site A during a telephone call. Through this process, stream data in which an S/N ratio is high and a reverberant feeling is suppressed is transmitted to the site B.

Considering a case in which the user A speaks while moving, the acoustic system according to the present embodiment can cope with this case by continuously performing the data collection. Specifically, the acoustic system according to the present embodiment continuously performs data collection on the basis of the plurality of microphones, the plurality of image sensors, the plurality of human sensors, and the like, and detects a moving path of the user A or a direction in which the user A is heading. Then, the acoustic system according to the present embodiment continuously updates selection of an appropriate microphone group arranged around the moving user A, and continuously performs the array microphone process so that the sound acquisition point is constantly focused on the moving user A's mouth. Through this operation, the acoustic system according to the present embodiment can cope with a case in which the user A speaks while moving.

Further, separately from stream data of a voice, a moving direction and the direction of the user A or the like is converted into metadata and transmitted to the site B together with the stream data.

(Object Synthesis)

Further, the stream data transmitted to the site B is reproduced through the speakers arranged around the user B located at the site B. At this time, the acoustic system according to the present embodiment performs data collection at the site B through the plurality of microphones, the plurality of image sensors, and the plurality of human sensors, estimates the user B's position on the basis of the collected data, and selects an appropriate speaker group surrounding the user B through an acoustically closed surface. The stream data transmitted to the site B is reproduced through the selected speaker group, and an area inside the acoustically closed surface is controlled as an appropriate sound field. In this disclosure, a surface formed such that positions of a plurality of adjacent speakers or a plurality of adjacent microphones, are connected to surround an object (the user, for example) is referred to conceptually as an "acoustically closed surface." Further, the "acoustically closed surface" does not necessarily configure a perfect closed surface, and is preferably configured to approximately surround the target object (the user, for example).

Further, the sound field may be appropriately selected by the user B. For example, in the case where the user B designates the site A as the sound field, the acoustic system according to the present embodiment reconstructs the environment of the site A in the site B. Specifically, for example, the environment of the site A is reconstructed in the site B on the basis of sound information as an ambience acquired in real time and meta information related to the site A that has been acquired in advance.

Further, the acoustic system according to the present embodiment may control the user A's audio image using the plurality of speakers 20B arranged around the user B at the site B. In other words, the acoustic system according to the present embodiment may reconstruct the user A's voice (audio image) in the user B's ear or outside the acoustically closed surface by forming an array speaker (beam forming). Further, the acoustic system according to the present embodiment may cause the user A's audio image to move around the user B according to the user A's actual movement at the site B using metadata of the moving path or the direction of the user A.

The outline of voice communication from the site A to the site B has been described above in connection with respective steps of the data collection process, the object decomposition process, and the object synthesis process, but of course, a similar process is performed in voice communication from the site B to the site A. Thus, two-way voice communication can be performed between the site A and the site B.

The outline of the acoustic system (information processing system) according to an embodiment of the present disclosure has been described above.

Next, a configuration of the acoustic system according to the present embodiment will be described in detail with reference to FIGS. 2 to 5.

<2. Basic Configuration>

[2-1. System Configuration]

Figure 2:
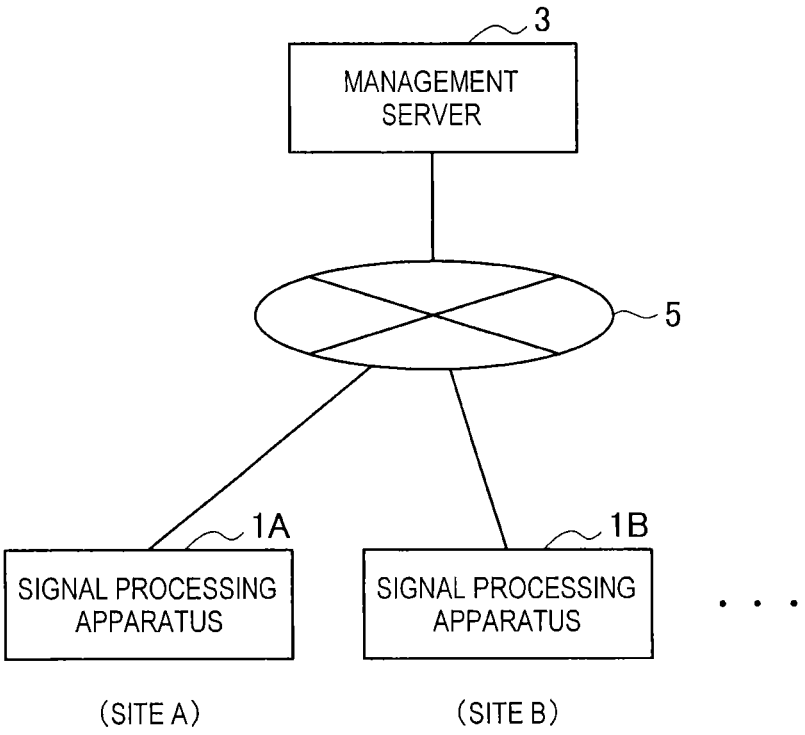
FIG. 2 is a diagram showing a system configuration of an acoustic system according to an embodiment of the present disclosure.

FIG. 2 is a diagram illustrating an overall configuration of the acoustic system according to the present embodiment. As shown in FIG. 2, the acoustic system includes a signal processing apparatus 1A, a signal processing apparatus 1B, and a management server 3.

The signal processing apparatus 1A and the signal processing apparatus 1B are connected to a network 5 in a wired/wireless manner, and can transmit or receive data to or from one another via the network 5. The management server 3 is connected to the network 5, and the signal processing apparatus 1A and the signal processing apparatus 1B can transmit or receive data to or from the management server 3.

The signal processing apparatus 1A processes signals input or output by the plurality of microphones 10A and the plurality of speakers 20A arranged at the site A. The signal processing apparatus 1B processes signals input or output by the plurality of microphones 10B and the plurality of speakers 20B arranged at the site B. Further, when it is unnecessary to distinguish the signal processing apparatuses 1A and 1B from one another, the signal processing apparatuses 1A and 1B are referred to collectively as a "signal processing apparatus 1."

The management server 3 has a function of performing a user authentication process and managing a user's absolute position (current position). Further, the management server 3 may also manage information (for example, IP address) representing a position of a place or a building.

Thus, the signal processing apparatus 1 can send a query for access destination information (for example, IP address) of a given target (person, place, building, or the like) designated by the user to the management server 3 and can acquire the access destination information.

[2-2. Signal Processing Apparatus]

Figure 3:
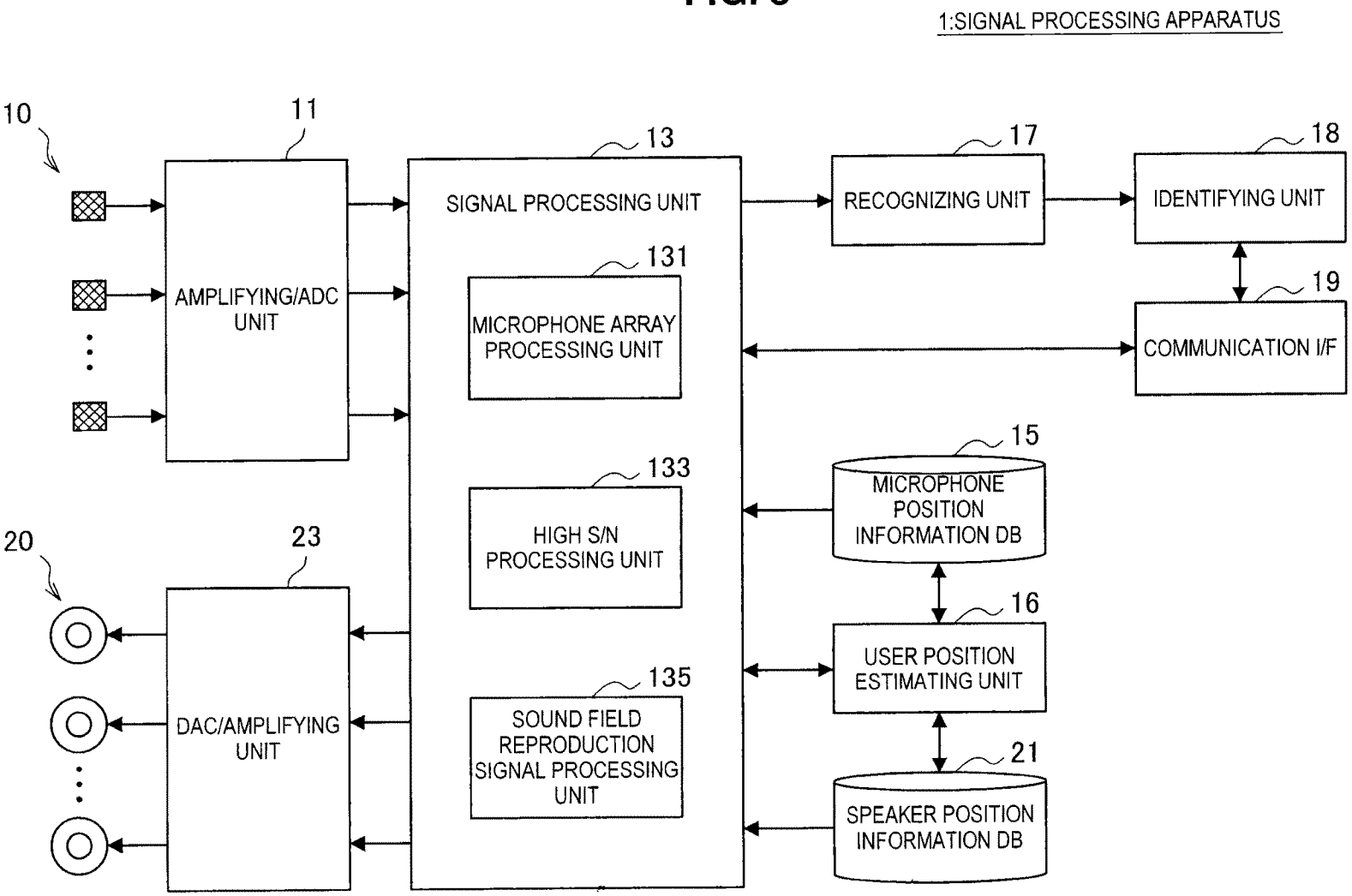
FIG. 3 is a block diagram showing a configuration of a signal processing apparatus according to the present embodiment.

Next, a configuration of the signal processing apparatus 1 according to the present embodiment will be described in detail. FIG. 3 is a block diagram showing a configuration of the signal processing apparatus 1 according to the present embodiment. As shown in FIG. 3, the signal processing apparatus 1 according to the present embodiment includes a plurality of microphones 10 (array microphone), an amplifying/analog-to-digital converter (ADC) unit 11, a signal processing unit 13, a microphone position information database (DB) 15, a user position estimating unit 16, a recognizing unit 17, an identifying unit 18, a communication interface (I/F) 19, a speaker position information DB 21, a digital-to-analog converter (DAC)/amplifying unit 23, and a plurality of speakers 20 (array speaker). The components will be described below.

(Array Microphone)

The plurality of microphones 10 are arranged throughout a certain area (site) as described above. For example, the plurality of microphones 10 are arranged at outdoor sites such as roads, electric poles, street lamps, houses, and outer walls of buildings and indoor sites such as floors, walls, and ceilings. The plurality of microphones 10 acquire ambient sounds, and output the acquired ambient sounds to the amplifying/ADC unit 11.

(Amplifying/ADC Unit)

The amplifying/ADC unit 11 has a function (amplifier) of amplifying acoustic waves output from the plurality of microphones 10 and a function (ADC) of converting an acoustic wave (analog data) into an audio signal (digital data). The amplifying/ADC unit 11 outputs the converted audio signals to the signal processing unit 13.

(Signal Processing Unit)

The signal processing unit 13 has a function of processing the audio signals acquired by the microphones 10 and transmitted through the amplifying/ADC unit 11 and the audio signals reproduced by the speakers 20 through the DAC/amplifying unit 23. Further, the signal processing unit 13 according to the present embodiment functions as a microphone array processing unit 131, a high S/N processing unit 133, and a sound field reproduction signal processing unit 135.

Microphone Array Processing Unit

The microphone array processing unit 131 performs directivity control such that the user's voice is focused on (a sound acquisition position is focused on the user's mouth) in the microphone array process for a plurality of audio signals output from the amplifying/ADC unit 11.

At this time, the microphone array processing unit 131 may select a microphone group forming the acoustically closed surface surrounding the user which is optimal for acquisition of the user's voice, on the basis of the user's position estimated by the user position estimating unit 16 or the positions of the microphones 10 registered to the microphone position information DB 15. Then, the microphone array processing unit 131 performs directivity control on the audio signals acquired by the selected microphone group. Further, the microphone array processing unit 131 may form super directivity of the array microphone through a delay-and-sum array process and a null generation process.

High S/N Processing Unit

The high S/N processing unit 133 has a function of processing a plurality of audio signals output from the amplifying/ADC unit 11 to form a monaural signal having high articulation and a high S/N ratio. Specifically, the high S/N processing unit 133 performs sound source separation, and performs dereverberation and noise reduction.

Further, the high S/N processing unit 133 may be disposed at a stage subsequent to the microphone array processing unit 131. Further, the audio signals (stream data) processed by the high S/N processing unit 133 are used for voice recognition performed by the recognizing unit 17 and are transmitted to an outside through a communication 1/F 19.

Sound Field Reproduction Signal Processing Unit

The sound field reproduction signal processing unit 135 performs signal processing on the audio signals to be reproduced through the plurality of speakers 20, and performs control such that a sound field is localized around the user's position. Specifically, for example, the sound field reproduction signal processing unit 135 selects an optimal speaker group for forming the acoustically closed surface surrounding the user on the basis of the user's position estimated by the user position estimating unit 16 or the positions of the speakers 20 registered to the speaker position information DB 21. Then, the sound field reproduction signal processing unit 135 writes the audio signals which have been subjected to signal processing in output buffers of a plurality of channels corresponding to the selected speaker group.

Further, the sound field reproduction signal processing unit 135 controls an area inside the acoustically closed surface as an appropriate sound field. As a method of controlling the sound field, for example, the Helmholtz-Kirchhoff integral theorem and the Rayleigh integral theorem are known, and wave field synthesis (WFS) based on the theorems is generally known. Further, the sound field reproduction signal processing unit 135 may apply signal processing techniques disclosed in JP 4674505B and JP 4735108B.

Figure 4:
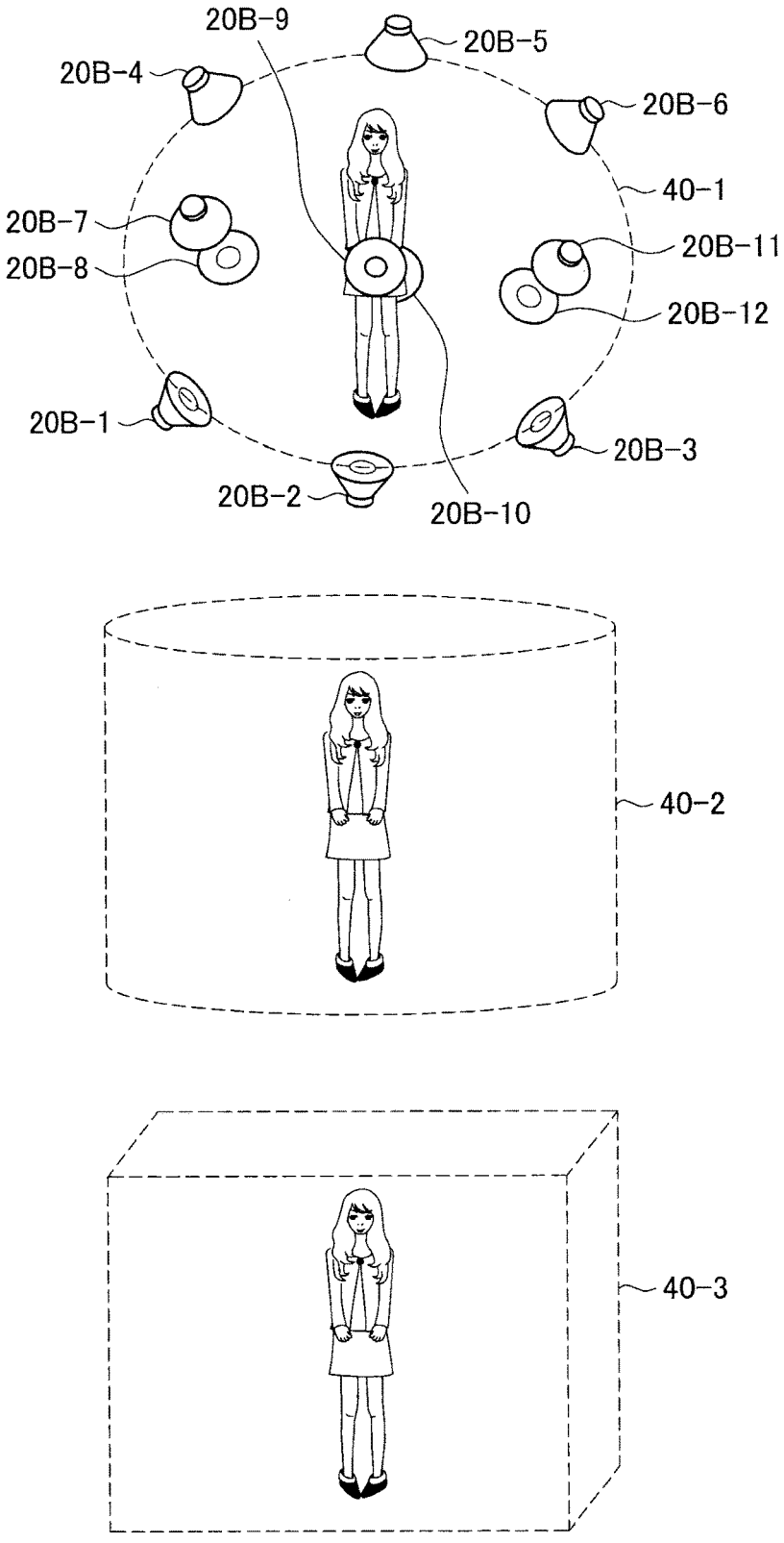
FIG. 4 is a diagram illustrating shapes of acoustically closed surfaces according to the present embodiment.

Note that the shape of the acoustically closed surface formed by the microphones or the speakers is not particularly limited as long as it is a three-dimensional shape surrounding the user, and, as shown in FIG. 4, examples of the shape may include an acoustically closed surface 40-1 having an oval shape, an acoustically closed surface 40-2 having a columnar shape, and an acoustically closed surface 40-3 having a polygonal shape. The examples illustrated in FIG. 4 show as examples the shapes of the acoustically closed surfaces formed by a plurality of speakers 20B-1 to 20B-12 arranged around the user B in the site B. The examples also apply to the shapes of the acoustically closed surfaces formed by the plurality of microphones 10.

(Microphone Position Information DB)

The microphone position information DB 15 is a storage unit that stores position information of the plurality of microphones 10 arranged at the site. The position information of the plurality of microphones 10 may be registered in advance.

(User Position Estimating Unit)

The user position estimating unit 16 has a function of estimating the user's position. Specifically, the user position estimating unit 16 estimates the user's relative position to the plurality of microphones 10 or the plurality of speakers 20 on the basis of the analysis result of the sounds acquired by the plurality of microphones 10, the analysis result of the captured images obtained by the image sensors, or the detection result obtained by the human sensors. The user position estimating unit 16 may acquire Global Positioning System (GPS) information and may estimate the user's absolute position (current position information).

(Recognizing Unit) The recognizing unit 17 analyzes the user's voice on the basis of the audio signals which are acquired by the plurality of microphones 10 and then processed by the signal processing unit 13, and recognizes a command. For example, the recognizing unit 17 performs morphological analysis on the voice of the user "I'd like to speak with B," and recognizes a call origination request command on the basis of the given target "B" that is designated by the user and the request "I'd like to speak with."

(Identifying Unit)

The identifying unit 18 has a function of identifying the given target recognized by the recognizing unit 17. Specifically, for example, the identifying unit 18 may decide the access destination information for acquiring a voice and an image corresponding to the given target. For example, the identifying unit 18 may transmit information representing the given target to the management server 3 through the communication I/F 19, and acquire the access destination information (for example, IP address) corresponding to the given target from the management server 3.

(Communication I/F)

The communication I/F 19 is a communication module for transmitting or receiving data to or from another signal processing apparatus or the management server 3 via the network 5. For example, the communication I/F 19 according to the present embodiment sends a query for access destination information corresponding to the given target to the management server 3, and transmits the audio signal which is acquired by the microphone 10 and then processed by the signal processing unit 13 to another signal processing apparatus which is an access destination.

(Speaker Position Information DB)

The speaker position information DB 21 is a storage unit that stores position information of the plurality of speakers 20 arranged at the site. The position information of the plurality of speakers 20 may be registered in advance.

(DAC/Amplifying Unit)

The DAC/amplifying unit 23 has a function (DAC) of converting the audio signals (digital data), which are written in the output buffers of the channels, to be respectively reproduced through the plurality of speakers 20 into acoustic waves (analog data). In addition, the DAC/amplifying unit 23 has a function of amplifying acoustic waves reproduced from the plurality of speakers 20, respectively.

Further, the DAC/amplifying unit 23 according to the present embodiment performs DA conversion and amplifying process on the audio signals processed by the sound field reproduction signal processing unit 135, and outputs the audio signals to the speakers 20.

(Array Speaker)

The plurality of speakers 20 are arranged throughout a certain area (site) as described above. For example, the plurality of speakers 20 are arranged at outdoor sites such as roads, electric poles, street lamps, houses, and outer walls of buildings and indoor sites such as floors, walls, and ceilings. Further, the plurality of speakers 20 reproduce the acoustic waves (voices) output from the DAC/amplifying unit 23.

Heretofore, the configuration of the signal processing apparatus 1 according to the present embodiment has been described in detail. Next, with reference to FIG. 5, the configuration of the management server 3 according to the present embodiment will be described.

[2-3. Management Server]

Figure 5:
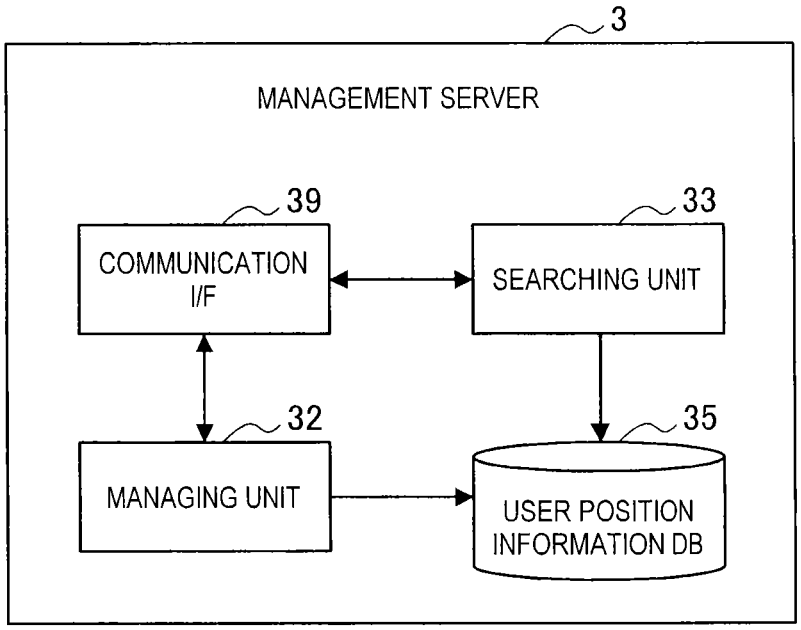
FIG. 5 is a block diagram showing a configuration of a management server according to the present embodiment.

FIG. 5 is a block diagram showing a configuration of the management server 3 according to the present embodiment. As shown in FIG. 5, the management server 3 includes a managing unit 32, a searching unit 33, a user position information DB 35, and a communication I/F 39. The above-mentioned components will be described below.

(Managing Unit)

The managing unit 32 manages information associated with a place (site) at which the user is currently located on the basis of a user ID transmitted from the signal processing apparatus 1. For example, the managing unit 32 identifies the user on the basis of the user ID, and stores an IP address of the signal processing apparatus 1 of a transmission source in the user position information DB 35 in association with a name of the identified user or the like as the access destination information. The user ID may include a name, a personal identification number, or biological information. Further, the managing unit 32 may perform the user authentication process on the basis of the transmitted user ID.

(User Position Information DB)

The user position information DB 35 is a storage unit that stores information associated with a place at which the user is currently located according to management by the managing unit 32. Specifically, the user position information DB 35 stores the user ID and the access destination information (for example, an IP address of a signal processing apparatus corresponding to a site at which the user is located) in association with each other. Further, current position information of each user may be constantly updated.

(Searching Unit)

The searching unit 33 searches for the access destination information with reference to the user position information DB 35 according to the access destination (call origination destination) query from the signal processing apparatus 1. Specifically, the searching unit 33 searches for the associated access destination information and extracts the access destination information from the user position information DB 35 on the basis of, for example, a name of a target user included in the access destination query.

(Communication I/F)

The communication I/F 39 is a communication module that transmits or receives data to or from the signal processing apparatus 1 via the network 5. For example, the communication I/F 39 according to the present embodiment receives the user ID and the access destination query from the signal processing apparatus 1. Further, the communication I/F 39 transmits the access destination information of the target user in response to the access destination query.

Heretofore, the components of the acoustic system according to an embodiment of the present disclosure have been described in detail. Next, with reference to FIGS. 6 to 9, an operation process of the acoustic system according to the present embodiment will be described in detail.

<3. Operation Process>

[3-1. Basic Process]

Figure 6:
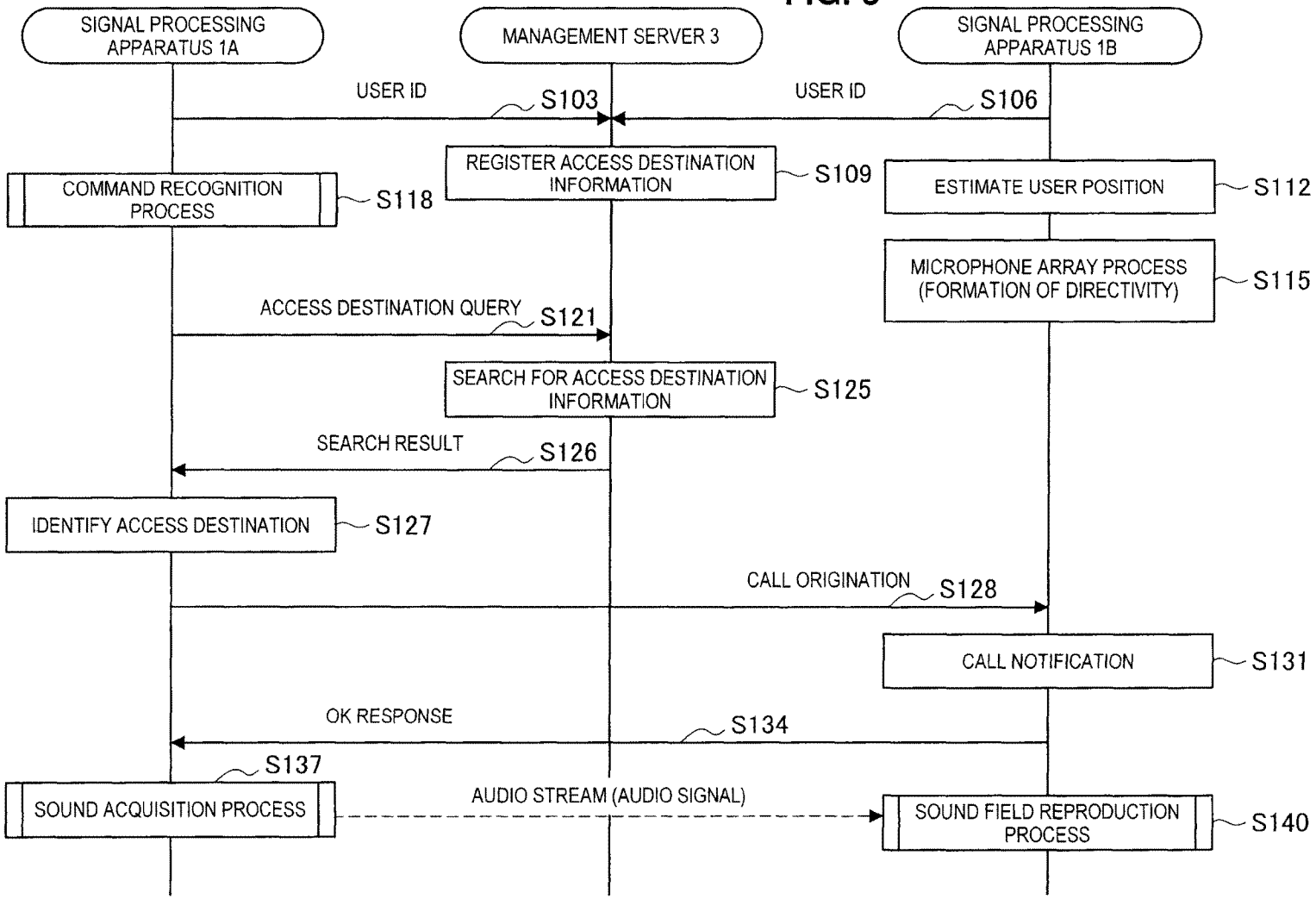
FIG. 6 is a flowchart showing a basic process of the acoustic system according to the present embodiment.

FIG. 6 is a flowchart showing a basic process of the acoustic system according to the present embodiment. As shown in FIG. 6, first of all, in step S103, the signal processing apparatus 1A transmits an ID of the user A located at the site A to the management server 3. The signal processing apparatus 1A may acquire an ID of the user A from a tag such as a radio frequency identification (RFID) tag possessed by the user A or from the user A's voice. Further, the signal processing apparatus 1A may read biological information from the user A (a face, an eye, a hand, or the like), and acquire the biological information as an ID.

Meanwhile, in step S106, the signal processing apparatus 1B similarly transmits an ID of the user B located at the site B to the management server 3.

Next, in step S109, the management server 3 identifies the user on the basis of the user ID transmitted from each signal processing apparatus 1, and registers, for example, an IP address of the signal processing apparatus 1 of the transmission source as the access destination information in association with, for example, the identified user's name.

Next, in step S112, the signal processing apparatus 1B estimates the position of the user B located at the site B. Specifically, the signal processing apparatus 1B estimates the user B's relative position to the plurality of microphones arranged at the site B.

Next, in step S115, the signal processing apparatus 1B performs the microphone array process on the audio signals acquired by the plurality of microphones arranged at the site B on the basis of the user B's estimated relative position so that the sound acquisition position is focused on the user B's mouth. As described above, the signal processing apparatus 1B prepares for the user B to utter something.

On the other hand, in step S118, the signal processing apparatus 1A similarly performs the microphone array process on the audio signals acquired by the plurality of microphones arranged at the site A so that the sound acquisition position is focused on the user A's mouth, and prepares for the user A to utter something. Then, the signal processing apparatus 1A recognizes a command on the basis of the user A's voice (utterance). Here, the description will continue with an example in which the user A utters "I'd like to speak with B," and the signal processing apparatus 1A recognizes the utterance as a command of the "call origination request to the user B." A command recognition process according to the present embodiment will be described in detail in [3-2. Command recognition process] which will be described later.

Next, in step S121, the signal processing apparatus 1A sends the access destination query to the management server 3. When the command is the "call origination request to the user B" as described above, the signal processing apparatus 1A queries the access destination information of the user B.

Next, in step S125, the management server 3 searches for the access destination information of the user B in response to the access destination query from the signal processing apparatus 1A, and then, in step S126 that follows, transmits the search result to the signal processing apparatus 1A.

Next, in step S127, the signal processing apparatus 1A identifies (determines) an access destination on the basis of the access destination information of the user B received from the management server 3.

Next, in step S128, the signal processing apparatus 1A performs the process of originating a call to the signal processing apparatus 1B on the basis of the access destination information of the identified user B, for example, an IP address of the signal processing apparatus 1B corresponding to the site B at which the user B is currently located.

Next, in step S131, the signal processing apparatus 1B outputs a message asking the user B whether to answer a call from the user A or not (call notification). Specifically, for example, the signal processing apparatus 1B may reproduce a corresponding message through the speakers arranged around the user B. Further, the signal processing apparatus 1B recognizes the user B's response to the call notification on the basis of the user B's voice acquired through the plurality of microphones arranged around the user B.

Next, in step S134, the signal processing apparatus 1B transmits the response of the user B to the signal processing apparatus 1A. Here, the user B gives an OK response, and thus, two-way communication starts between the user A (signal processing apparatus 1A side) and the user B (signal processing apparatus 1B side).

Specifically, in step S137, in order to start communication with the signal processing apparatus 1B, the signal processing apparatus 1A performs a sound acquisition process of acquiring the user A's voice at the site A and transmitting an audio stream (audio signals) to the site B (signal processing apparatus 1B side). The sound acquisition process according to the present embodiment will be described in detail in [3-3. Sound acquisition process] which will be described later.

Then, in step S140, the signal processing apparatus 1B forms the acoustically closed surface surrounding the user B through the plurality of speakers arranged around the user B, and performs a sound field reproduction process on the basis of the audio stream transmitted from the signal processing apparatus 1A. Note that the sound field reproduction process according to the present embodiment will be described in detail in "3-4. Sound field reproduction process" which will be described later.

In steps S137 to S140 described above, one-way communication has been described as an example, but in the present embodiment, two-way communication can be performed. Accordingly, unlike steps S137 to S140 described above, the signal processing apparatus 1B may perform the sound acquisition process, and the signal processing apparatus 1A may perform the sound field reproduction process.

Heretofore, the basic process of the acoustic system according to the present embodiment has been described. Through the above-described process, the user A can speak on the telephone with the user B located at a different place by uttering "I'd like to speak with B" without carrying a mobile phone terminal, a smartphone, or the like, by using the plurality of microphones and the plurality of speakers arranged around the user A. Next, the command recognition process performed in step S118 will be described in detail with reference to FIG. 7.

[3-2. Command Recognition Process]

Figure 7:
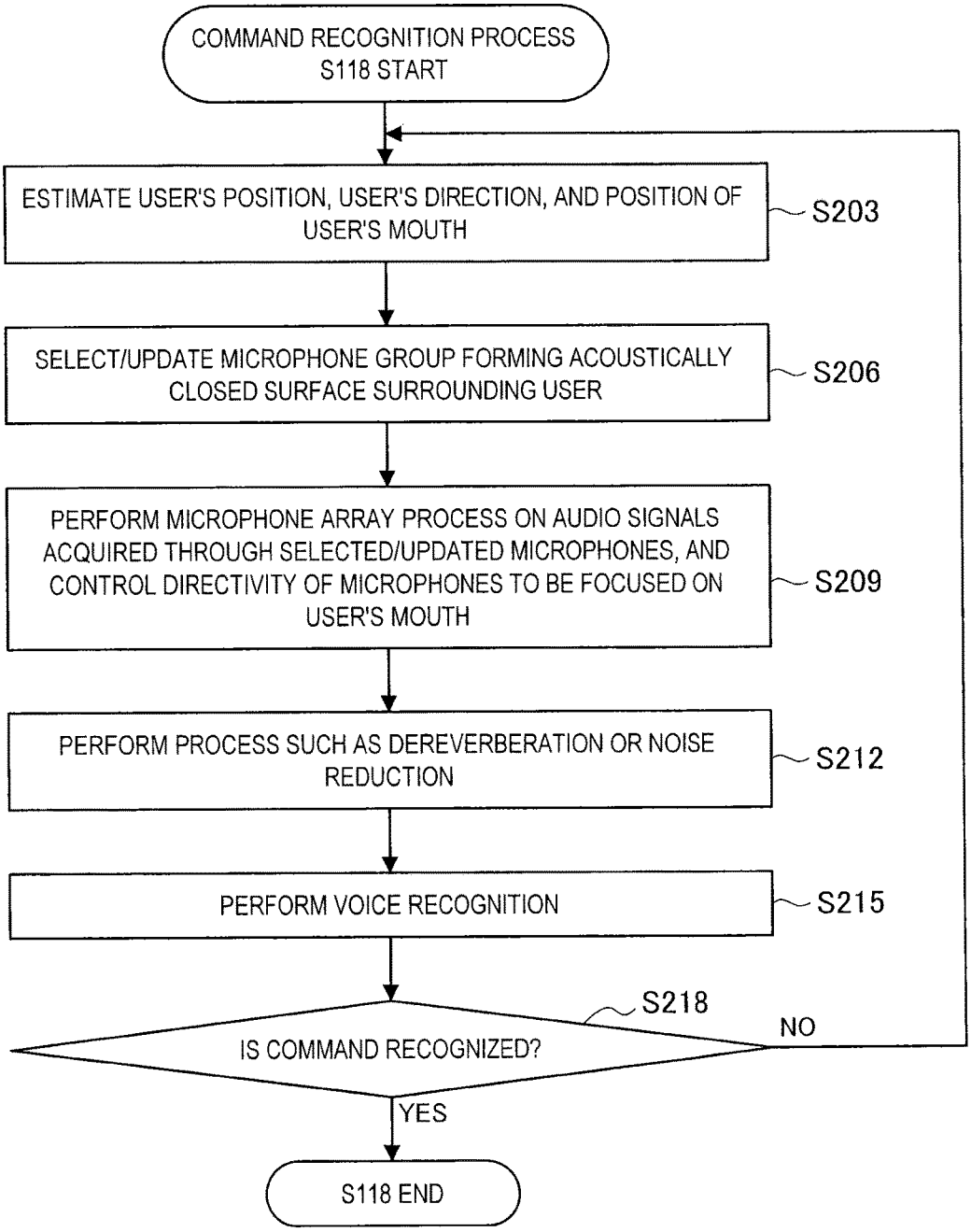
FIG. 7 is a flowchart showing a command recognition process according to the present embodiment.

FIG. 7 is a flowchart showing the command recognition process according to the present embodiment. As shown in FIG. 7, first of all, in step S203, the user position estimating unit 16 of the signal processing apparatus 1 estimates the user's position. For example, the user position estimating unit 16 may estimate the relative position and direction of the user to each microphone, and the position of the user's mouth on the basis of sounds acquired through the plurality of microphones 10, captured images obtained by the image sensors, an arrangement of the microphones stored in the microphone position information DB 15, or the like.

Next, in step S206, the signal processing unit 13 selects the microphone group forming the acoustically closed surface surrounding the user according to the user's relative position and direction, and the position of the user's mouth that have been estimated.

Next, in step S209, the microphone array processing unit 131 of the signal processing unit 13 performs the microphone array process on the audio signals acquired through the selected microphone group, and controls directivity of the microphones to be focused on the user's mouth. Through this process, the signal processing apparatus 1 can prepare for the user to utter something.

Next, in step S212, the high S/N processing unit 133 performs a process such as dereverberation or noise reduction on the audio signal processed by the microphone array processing unit 131 to improve the S/N ratio.

Next, in step S215, the recognizing unit 17 performs voice recognition (voice analysis) on the basis of the audio signal output from the high S/N processing unit 133.

Then, in step S218, the recognizing unit 17 performs the command recognition process on the basis of the recognized voice (audio signal). There is no particular restriction to concrete content of the command recognition process, but for example, the recognizing unit 17 may recognize a command by comparing a previously registered (learned) request pattern with the recognized voice.

When a command is not recognized in step S218 (No in S218), the signal processing apparatus 1 repeatedly performs the process performed in steps S203 to S215. At this time, since steps S203 and S206 are also repeated, the signal processing unit 13 can update the microphone group forming the acoustically closed surface surrounding the user according to the user's movement.

[3-3. Sound Acquisition Process]

Figure 8:
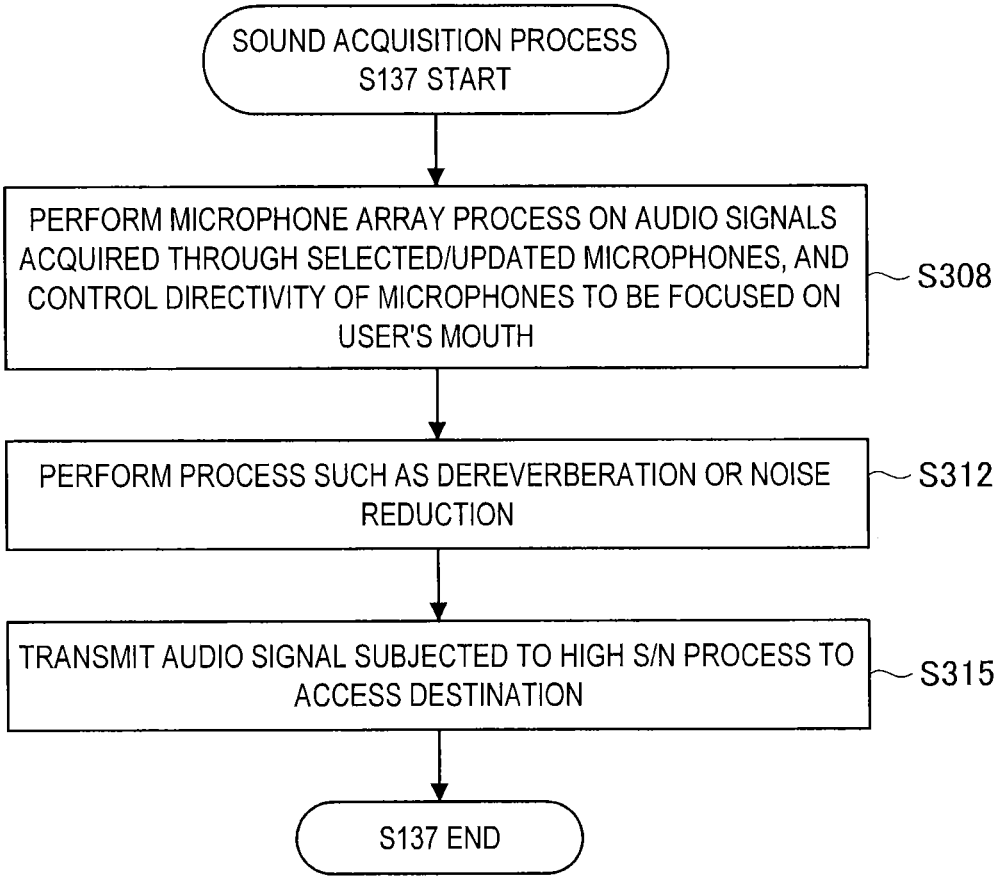
FIG. 8 is a flowchart showing a sound acquisition process according to the present embodiment.

Next, the sound acquisition process performed in step S137 of FIG. 6 will be described in detail with reference to FIG. 8. FIG. 8 is a flowchart showing the sound acquisition process according to the present embodiment. As shown in FIG. 8, first of all, in step S308, the microphone array processing unit 131 of the signal processing unit 13 performs the microphone array process on the audio signals acquired through the selected/updated microphones, and controls directivity of the microphones to be focused on the user's mouth.

Next, in step S312, the high S/N processing unit 133 performs the process such as dereverberation or noise reduction on the audio signal processed by the microphone array processing unit 131 to improve the S/N ratio.

Then, in step S315, the communication I/F 19 transmits the audio signal output from the high S/N processing unit 133 to the access destination (for example, signal processing apparatus 1B) represented by the access destination information of the target user identified in step S126 (see FIG. 6). Through this process, a voice uttered by the user A at the site A is acquired by the plurality of microphones arranged around the user A and then transmitted to the site B.

[3-4. Sound Field Reproduction Process]

Figure 9:
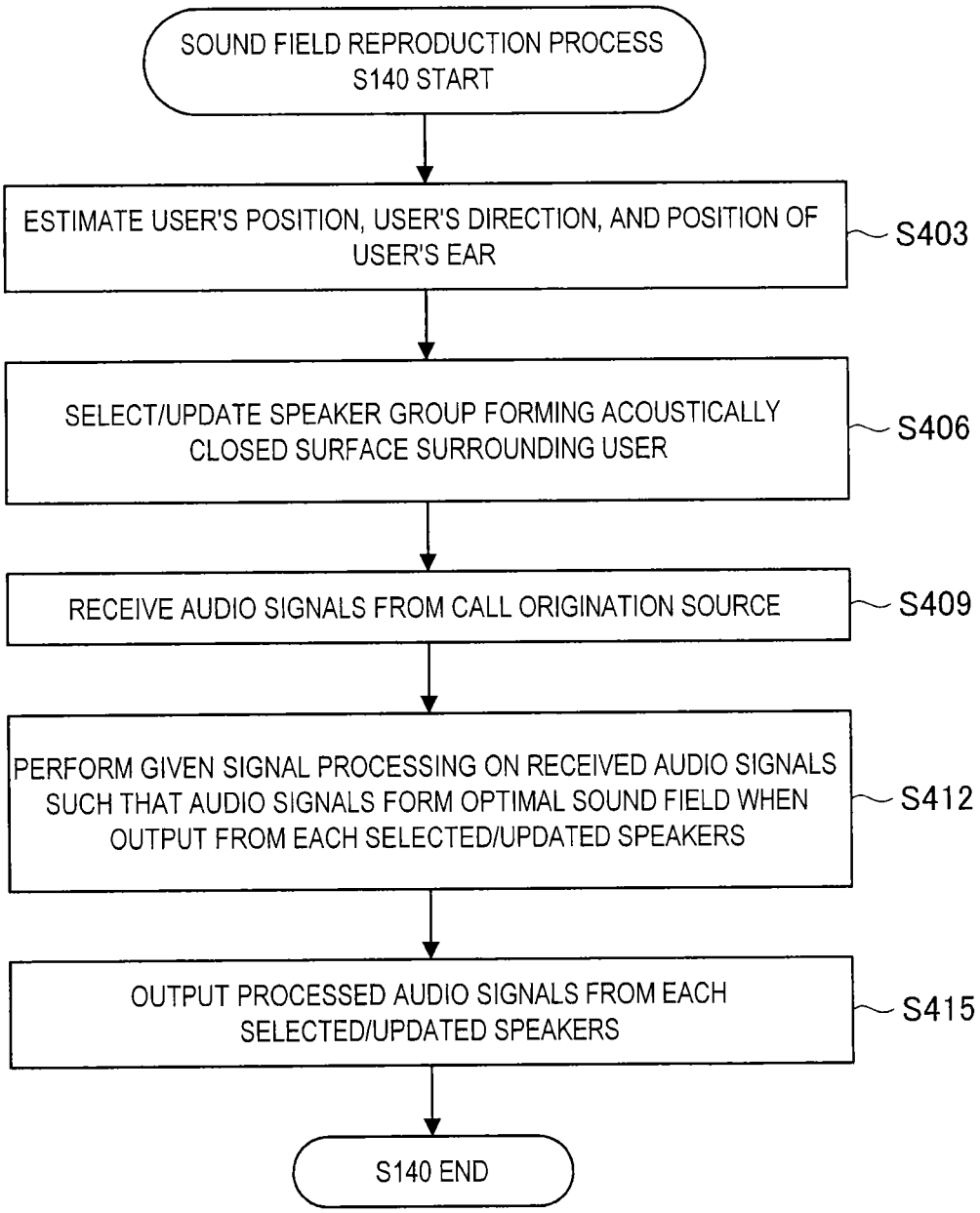
FIG. 9 is a flowchart showing a sound field reproduction process according to the present embodiment.

Next, with reference to FIG. 9, the sound field reproduction process shown in step S140 of FIG. 6 will be described in detail. FIG. 9 is a flowchart showing a sound field reproduction process according to the present embodiment. As shown in FIG. 9, first, in step S403, the user position estimating unit 16 of the signal processing apparatus 1 estimates the position of the user. For example, the user position estimating unit 16 may estimate the relative position, direction, and position of the ear of the user with respect to each speaker 20 on the basis of sound acquired from the plurality of microphones 10, captured images obtained by the image sensors, and arrangement of the speakers stored in the speaker position information DB 21.

Next, in step S406, the signal processing unit 13 selects a speaker group forming the acoustically closed surface surrounding the user on the basis of the estimated relative position, direction, and position of the ear of the user. Note that, steps S403 and S406 are executed continuously, and thus, the signal processing unit 13 can update the speaker group forming the acoustically closed surface surrounding the user in accordance with the movement of the user.

Next, in step S409, the communication I/F 19 receives audio signals from a call origination source.

Next, in step S412, the sound field reproduction signal processing unit 135 of the signal processing unit 13 performs given signal processing on the received audio signals such that the audio signals form an optimal sound field when output from the selected/updated speakers. For example, the sound field reproduction signal processing unit 135 performs rendering on the received audio signals in accordance with the environment of the site B (here, arrangement of the plurality of speakers 20 on a floor, wall, and ceiling of a room).

Then, in step S415, the signal processing apparatus 1 outputs the audio signals processed by the sound field reproduction signal processing unit 135 from the speaker group selected/updated in step S406 through the DAC/amplifying unit 23.

In this way, the voice of the user A acquired in the site A is reproduced from the plurality of speakers arranged around the user B located at the site B. Further, in step S412, when the audio signals received in accordance with the environment of the site B is subjected to rendering, the sound field reproduction signal processing unit 135 may perform signal processing so as to construct the sound field of the site A.

Specifically, the sound field reproduction signal processing unit 135 may reconstruct the sound field of the site A in the site B on the basis of a sound as an ambience of the site A acquired in real time and measurement data (transfer function) of an impulse response in the site A. In this way, the user B located at the indoor site B, for example, can obtain a sound field feeling as if the user B were located at the outdoor, which is the same outdoor as where the user A is located, and can feel more affluent reality.

Further, the sound field reproduction signal processing unit 135 can control an audio image of the received audio signal (user A's voice) using the speaker group arranged around the user B. For example, as the array speaker (beam forming) is formed by the plurality of speakers, the sound field reproduction signal processing unit 135 can reconstruct the user A's voice in the user B's ear, and can reconstruct the user A's audio image outside the acoustically closed surface surrounding the user B.

Heretofore, each operation process of the acoustic system according to the present embodiment has been described in detail. Next, a supplement of the present embodiment will be described.

<4. Supplement>

[4-1. Modified Example of Command Input]

In the embodiment above, a command is input by a voice, but the method of inputting a command in the acoustic system according to the present disclosure is not limited to the audio input and may be another input method. Hereinafter, with reference to FIG. 10, another command input method will be described.

Figure 10:
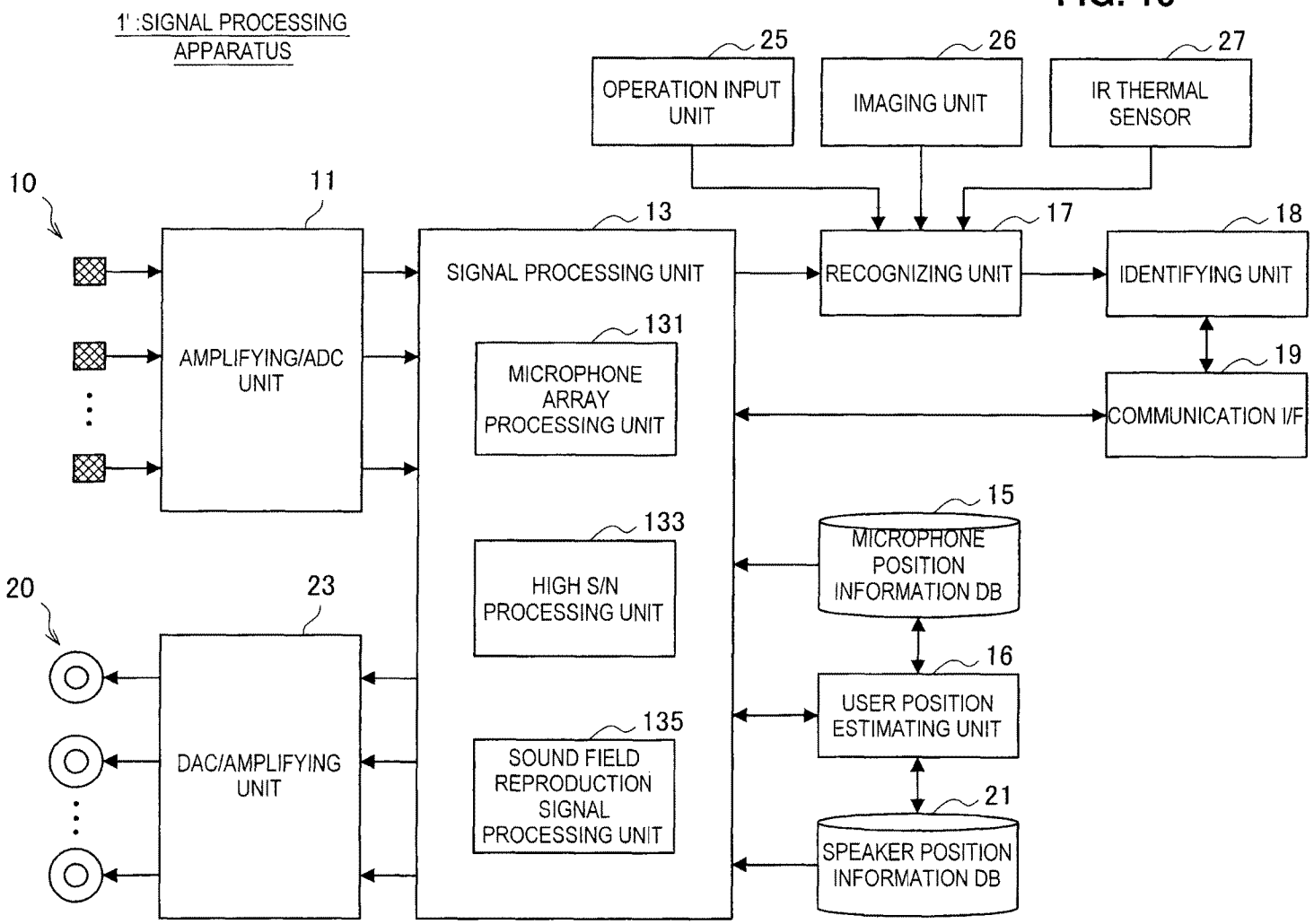
FIG. 10 is a block diagram showing another configuration example of the signal processing apparatus according to the present embodiment.

FIG. 10 is a block diagram showing another configuration example of the signal processing apparatus according to the present embodiment. As shown in FIG. 10, a signal processing apparatus 1' includes, in addition to the components of the signal processing apparatus 1 shown in FIG. 3, an operation input unit 25, an imaging unit 26, and an IR thermal sensor 27.

The operation input unit 25 has a function of detecting a user operation on each switch (not shown) arranged around a user. For example, the operation input unit 25 detects that a call origination request switch is pressed by the user, and outputs the detection result to the recognizing unit 17. The recognizing unit 17 recognizes a call origination command on the basis of the pressing of the call origination request switch. Note that, in this case, the operation input unit 25 is capable of accepting the designation of the call origination destination (name or the like of the target user).

Further, the recognizing unit 17 may analyze a gesture of the user on the basis of a captured image obtained by the imaging unit 26 (image sensor) disposed near the user or a detection result acquired by the IR thermal sensor 27, and may recognize the gesture as a command. For example, in the case where the user performs a gesture of making a telephone call, the recognizing unit 17 recognizes the call origination command. Further, in this case, the recognizing unit 17 may accept the designation of the call origination destination (name or the like of the target user) from the operation input unit 25 or may determine the designation on the basis of voice analysis.

As described above, the method of inputting a command in the acoustic system according to the present disclosure is not limited to the audio input, and may be the method using the switch pressing or the gesture input, for example.

[4-2. Example of Another Command]

In the embodiment above, there has been described the case where a person is designated as a given target and a call origination request (call request) is recognized as a command, but the command of the acoustic system according to the present disclosure is not limited to the call origination request (call request), and may be another command. For example, the recognizing unit 17 of the signal processing apparatus 1 may recognize a command in which a place, a building, a program, a music piece, or the like which has been designated as a given target is reconstructed in the space at which the user is located.

Figure 11:
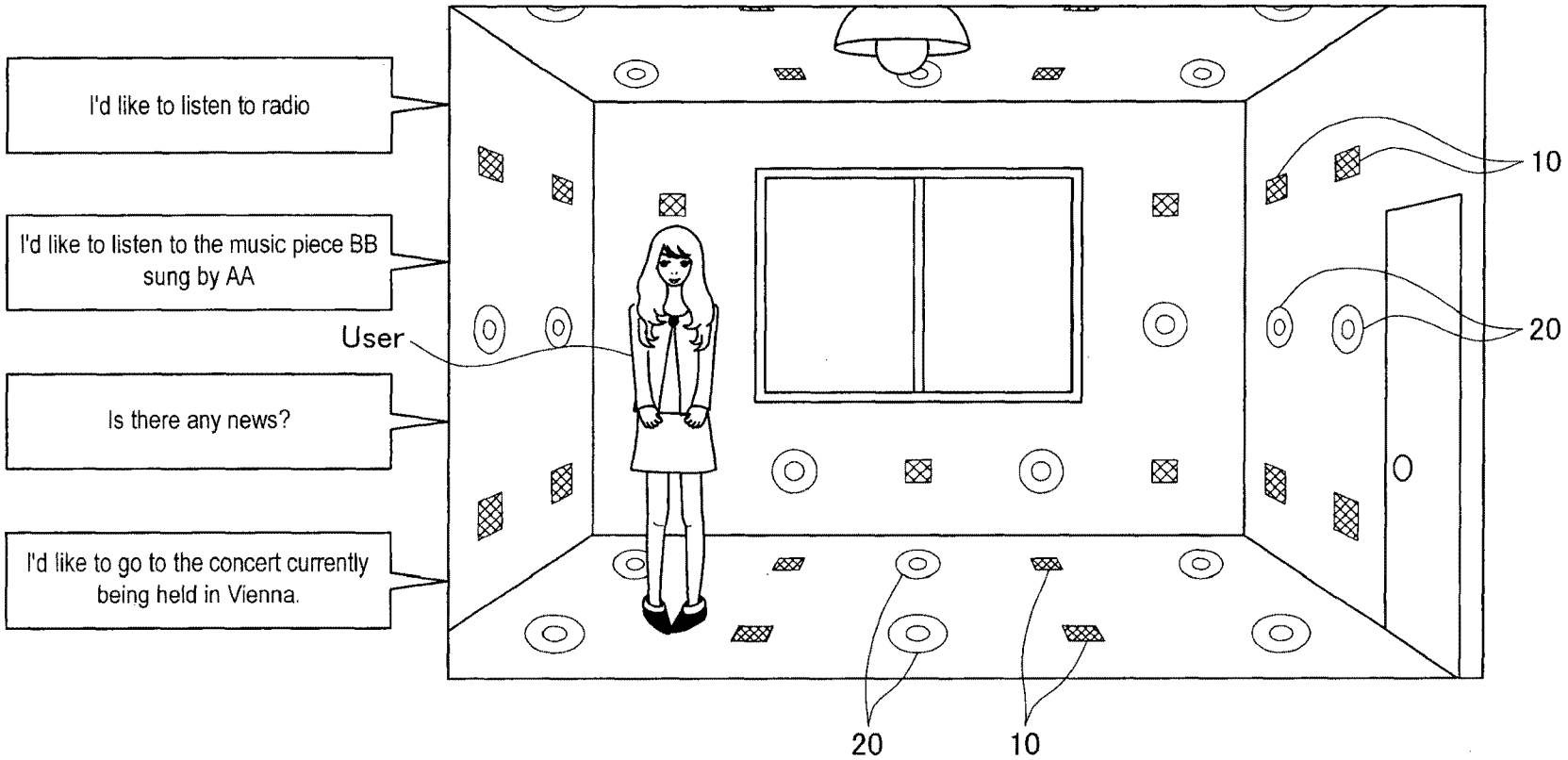
FIG. 11 is a diagram illustrating an example of another command according to the present embodiment.

For example, as shown in FIG. 11, in the case where the user utters requests other than the call origination request, such as "I'd like to listen to radio," "I'd like to listen to the music piece BB sung by AA," "is there any news?," and "I'd like to go to the concert currently being held in Vienna," the utterances are acquired by the plurality of microphones 10 arranged nearby and are recognized as commands by the recognizing unit 17.

Then, the signal processing apparatus 1 performs processes in accordance with the respective commands recognized by the recognizing unit 17. For example, the signal processing apparatus 1 may receive audio signals corresponding to the radio, music piece, news, concert, and the like that are to be designated by the user from a given server, and, through the signal processing performed by the sound field reproduction signal processing unit 135 as described above, may reproduce the audio signals from the speaker group arranged around the user. Note that the audio signals to be received by the signal processing apparatus 1 may be audio signals acquired in real time.

In this way, it is not necessary that the user carry or operate a terminal device such as a smartphone or a remote control, and the user can acquire a desired service only by uttering the desired service at the place where the user is at.

Further, particularly in the case where audio signals acquired in a large space such as an opera house are reproduced from a speaker group forming a small acoustically closed surface surrounding a user, the sound field reproduction signal processing unit 135 according to the present embodiment is capable of reconstructing reverberation and localization of an audio image in the large space.

That is, in the case where an arrangement of a microphone group forming an acoustically closed surface in a sound acquisition environment (for example, opera house) is different from an arrangement of a speaker group forming an acoustically closed surface in a reconstruction environment (for example, user's room), the sound field reproduction signal processing unit 135 is capable of reconstructing the localization of an audio image and the reverberation characteristics of the sound acquisition environment in the reconstruction environment by performing the given signal processing.

Specifically, for example, the sound field reproduction signal processing unit 135 may use the signal process using the transfer function disclosed in JP 4775487B. In JP 4775487B, a first transfer function (measurement data of impulse response) is determined on the basis of a sound field of a measuring environment, an audio signal subjected to an arithmetic process based on the first transfer function is reproduced in a reconstruction environment, and thus, the sound field (for example, reverberation and localization of an audio image) of the measuring environment is reconstructed in the reconstruction environment.

Figure 12:
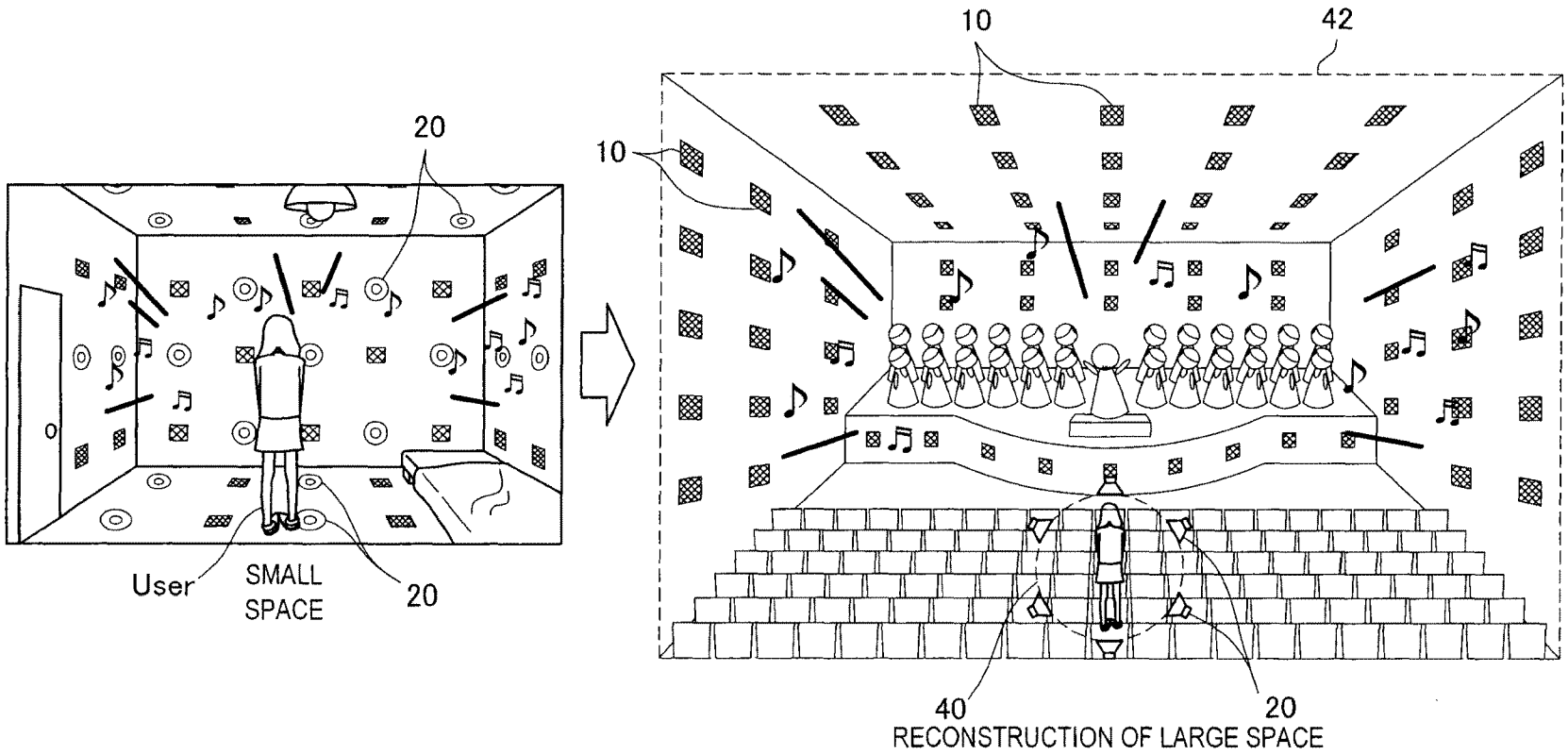
FIG. 12 is a diagram illustrating sound field construction of a large space according to the present embodiment.

In this way, as shown in FIG. 12, the sound field reproduction signal processing unit 135 becomes capable of constructing a sound field in which an acoustically closed surface 40 surrounding the user located in a small space can obtain localization of an audio image and reverberation effects so as to be absorbed in a sound field 42 of the large space. Note that, in the example shown in FIG. 12, out of a plurality of speakers 20 arranged in the small space (for example, room) at which the user is located, a plurality of speakers 20 forming the acoustically closed surface 40 surrounding the user are selected appropriately. Further, as shown in FIG. 12, in the large space (for example, opera house) which is a reconstruction target, a plurality of microphones 10 are arranged, the audio signals acquired by the plurality of microphones 10 are subjected to an arithmetic process based on a transfer function, and are reproduced from the selected plurality of speakers 20.

[4-3. Video Construction]

Further, the signal processing apparatus 1 according to the present embodiment can also perform, in addition to the sound field construction (sound field reproduction process) of another space described in the above-mentioned embodiment, video construction of another space.

For example, in the case where the user inputs a command "I'd like to watch a soccer game of AA currently being played," the signal processing apparatus 1 may receive audio signals and video acquired in a target stadium from a given server, and may reproduce the audio signals and the video in a room in which the user is located.

The reproduction of the video may be space projection using hologram reproduction, and may be reproduction using a television in a room, a display, or a head mounted display worn by the user. In this way, by performing video construction together with the sound field construction, the user can be provided with a feeling of being absorbed in the stadium, and can feel more affluent reality.

Note that a position (sound acquisition/imaging position) at which the user can be provided with a feeling of being absorbed in the target stadium can be appropriately selected and moved by the user. In this way, the user does not only stay at a given spectator stand, but is also capable of feeling the reality such as being in the stadium or chasing after a specific player.

[4-4. Another System Configuration Example]

In the system configuration of the acoustic system according to the embodiment described with reference to FIG. 1 and FIG. 2, both the call origination side (site A) and the call destination side (site B) have the plurality of microphones and speakers around the user, and the signal processing apparatuses 1A and 1B perform the signal process. However, the system configuration of the acoustic system according to the present embodiment is not limited to the configuration shown in FIG. 1 and FIG. 2, and may be the configuration as shown in FIG. 13, for example.

Figure 13:
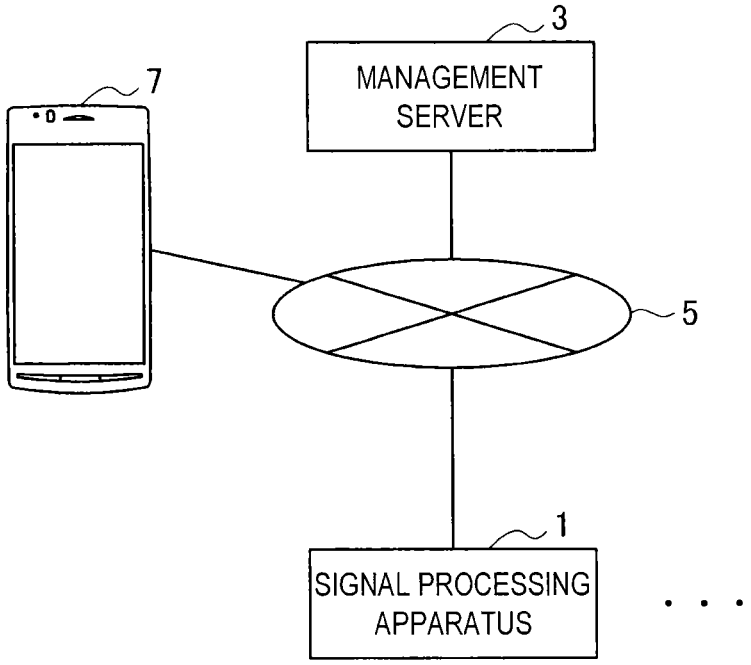
FIG. 13 is a diagram showing another system configuration of the acoustic system according to the present embodiment.

FIG. 13 is a diagram showing another system configuration of the acoustic system according to the present embodiment. As shown in FIG. 13, in the acoustic system according to the present embodiment, a signal processing apparatus 1, a communication terminal 7, and a management server 3 are connected to each other through a network 5.

The communication terminal 7 includes a mobile phone terminal or a smartphone including a normal single microphone and a normal single speaker, which is a legacy interface compared to an advanced interface space according to the present embodiment in which a plurality of microphones and a plurality of speakers are arranged.

The signal processing apparatus 1 according to the present embodiment is connected to the normal communication terminal 7, and can reproduce a voice received from the communication terminal 7 from the plurality of speakers arranged around the user. Further, the signal processing apparatus 1 according to the present embodiment can transmit the voice of the user acquired by the plurality of microphones arranged around the user to the communication terminal 7.

As described above, according to the acoustic system according to the present embodiment, a first user located at the space in which the plurality of microphones and the plurality of speakers are arranged nearby can speak on the telephone with a second user carrying the normal communication terminal 7. That is, the configuration of the acoustic system according to the present embodiment may be that one of the call origination side and the call destination side is the advanced interface space according to the present embodiment in which the plurality of microphones and the plurality of speakers are arranged.

5. CONCLUSION

As described above, in the acoustic system according to the present embodiment, it becomes possible to cause the space surrounding the user to cooperate with another space. Specifically, the acoustic system according to the present embodiment can reproduce a voice and an image corresponding to a given target (person, place, building, or the like) through a plurality of speakers and displays arranged around the user, and can acquire the voice of the user by the plurality of microphones arranged around the user and reproduce the voice of the user near the given target. In this manner, using the microphones 10, the speakers 20, the image sensors, and the like arranged everywhere, indoor sites and outdoor sites, it becomes possible to substantially augment over a large area the body such as the mouth, eyes, ears of the user, and to achieve a new communication method.

In addition, since microphones and image sensors are arranged everywhere in the acoustic system according to the present embodiment, the user does not have to carry a smartphone or a mobile phone terminal. The user specifies a given target using a voice or a gesture, and can establish connection with a space surrounding the given target.

The preferred embodiments of the present disclosure have been described above with reference to the accompanying drawings, whilst the present invention is not limited to the above examples, of course. A person skilled in the art may find various alterations and modifications within the scope of the appended claims, and it should be understood that they will naturally come under the technical scope of the present invention.

For example, the configuration of the signal processing apparatus l is not limited to the configuration shown in FIG. 3, and the configuration may be that the recognizing unit 17 and the identifying unit 18 shown in FIG. 3 are not provided to the signal processing apparatus 1 but are provided on the server side which is connected thereto through a network. In this case, the signal processing apparatus 1 transmits an audio signal output from the signal processing unit 13 to the server through the communication I/F 19. Further, the server performs the command recognition and the process of identifying a given target (person, place, building, program, music piece, or the like) on the basis of the received audio signal, and transmits the recognition results and the access destination information corresponding to the identified given target to the signal processing apparatus 1.

Additionally, the present technology may also be configured as below.

(1)

An information processing system including:

a recognizing unit configured to recognize a given target on the basis of signals detected by a plurality of sensors arranged around a specific user;

an identifying unit configured to identify the given target recognized by the recognizing unit;

an estimating unit configured to estimate a position of the specific user in accordance with the a signal detected by any one of the plurality of sensors; and a signal processing unit configured to process signals acquired from sensors around the given target identified by the identifying unit in a manner that, when output from a plurality of actuators arranged around the specific user, the signals are localized near the position of the specific user estimated by the estimating unit.

(2)

The information processing system according to (1), wherein the signal processing unit processes signals acquired from a plurality of sensors arranged around the given target.

(3)

The information processing system according to (1) or (2), wherein the plurality of sensors arranged around the specific user are microphones, and wherein the recognizing unit recognizes the given target on the basis of audio signals detected by the microphones.

(4)

The information processing system according to any one of (1) to (3), wherein the recognizing unit further recognizes a request to the given target on the basis of signals detected by sensors arranged around the specific user.

(5)

The information processing system according to (4), wherein the sensors arranged around the specific user are microphones, and wherein the recognizing unit recognizes a call origination request to the given target on the basis of audio signals detected by the microphones.

(6)

The information processing system according to (4), wherein the sensors arranged around the specific user are pressure sensors, and wherein, when a press on a specific switch is detected by the pressure sensors, the recognizing unit recognizes a call origination request to the given target.

(7)

The information processing system according to (4), wherein the sensors arranged around the specific user are image sensors, and wherein the recognizing unit recognizes a call origination request to the given target on the basis of captured images obtained by the image sensors.

(8)

The information processing system according to any one of (1) to (7), wherein the sensors around the given target are microphones, wherein the plurality of actuators arranged around the specific user are a plurality of speakers, and wherein the signal processing unit processes audio signals acquired by the microphones around the given target in a manner that a sound field is formed near a position of the specific user when output from the plurality of speakers, on the basis of respective positions of the plurality of speakers and the estimated position of the specific user.

(9)

An information processing system including:

a recognizing unit configured to recognize a given target on the basis of signals detected by sensors around a specific user;

an identifying unit configured to identify the given target recognized by the recognizing unit; and a signal processing unit configured to generate signals to be output from actuators around the specific user on the basis of signals acquired by a plurality of sensors arranged around the given target identified by the identifying unit.

(10)

A program for causing a computer to function as:

a recognizing unit configured to recognize a given target on the basis of signals detected by a plurality of sensors arranged around a specific user;

an identifying unit configured to identify the given target recognized by the recognizing unit;

an estimating unit configured to estimate a position of the specific user in accordance with the a signal detected by any one of the plurality of sensors; and a signal processing unit configured to process signals acquired from sensors around the given target identified by the identifying unit in a manner that, when output from a plurality of actuators arranged around the specific user, the signals are localized near the position of the specific user estimated by the estimating unit.

(11)

A program for causing a computer to function as:

a recognizing unit configured to recognize a given target on the basis of signals detected by sensors around a specific user;

an identifying unit configured to identify the given target recognized by the recognizing unit; and a signal processing unit configured to generate signals to be output from actuators around the specific user on the basis of signals acquired by a plurality of sensors arranged around the given target identified by the identifying unit.

REFERENCE SIGNS LIST

1, 1', 1A, 1B signal processing apparatus
3 management server
5 network
7 communication terminal
10, 10A, 10B microphone
11 amplifying/analog-to-digital converter (ADC) unit
13 signal processing unit
15 microphone position information database (DB)
16 user position estimating unit
17 recognizing unit
18 identifying unit
19 communication interface (I/F)
20, 20A, 20B speaker
23 digital-to-analog converter (DAC)/amplifying unit
25 operation input unit
26 imaging unit (image sensor)
27 IR thermal sensor
32 managing unit
33 searching unit
40, 40-1, 40-2, 40-3 acoustically closed surface
42 sound field
131 microphone array processing unit
133 high S/N processing unit
135 sound field reproduction signal processing unit

The invention claimed is:

1. An information processing system comprising:

circuitry configured to:

acquire an ID of a specific user from a tag possessed by the specific user to identify the specific user;

recognize a given target for communication with the specific user based on signals detected by a plurality of sensors arranged around the specific user by identifying a command within the signals, the given target being separate from the specific user;

estimate a position of the specific user in accordance with the signals detected by any one of the plurality of sensors;

select a group of sensors from the plurality of sensors that is optimal for acquisition of the signals detected by the plurality of sensors based on the estimated position of the specific user, a direction of the specific user and a position of the mouth of the specific user;

output the signals acquired by the group of sensors to the given target;

identify access destination information corresponding to the given target for acquiring other signals from the given target based on the recognized given target;

process the other signals acquired from another plurality of sensors around the given target in response to the output signals; and select a subset of a plurality of actuators arranged around the specific user to output the other signals to the specific user based on the estimated position of the specific user, wherein after selecting the group of sensors, the circuitry performs super directivity of the group of sensors via a delay-and-sum array processing and null generation processing directed at the mouth of the specific user.

2. The information processing system according to claim 1, wherein the plurality of sensors arranged around the specific user are microphones, and wherein the circuitry is configured to recognize the given target based on audio signals detected by the microphones.

3. The information processing system according to claim 1, wherein the circuitry is configured to recognize a request to the given target based on the signals detected by the plurality of sensors arranged around the specific user.

4. The information processing system according to claim 3, wherein the plurality of sensors arranged around the specific user are microphones, and wherein the circuitry is configured to recognize the request to the given target based on audio signals detected by the microphones.

5. The information processing system according to claim 3, wherein the plurality of sensors arranged around the specific user are pressure sensors, and wherein, when a press on a specific switch is detected by the pressure sensors, the circuitry is configured to recognize the request to the given target.

6. The information processing system according to claim 3, wherein the plurality of sensors arranged around the specific user are image sensors, and wherein the circuitry is configured to recognize the request to the given target based on captured images obtained by the image sensors.

7. The information processing system according to claim 1, wherein the another plurality of sensors around the given target are microphones, wherein the plurality of actuators arranged around the specific user are a plurality of speakers, and wherein the circuitry is configured to process audio signals acquired by the microphones around the given target in a manner that a sound field is formed near a position of the specific user when output from the plurality of speakers, based on respective positions of the plurality of speakers and the estimated position of the specific user.

8. The information processing system according to claim 1, wherein the circuitry is configured to select a subset of the plurality of sensors that detect the signals based on the estimated position of the specific user.

9. The information processing system according to claim 8, wherein the circuitry is configured to determine directivity of the subset of the plurality of sensors based on the estimated position of the specific user.

10. The information processing system according to claim 1, wherein the circuitry is configured to select another subset of the plurality of actuators arranged around the specific user to output new signals to the specific user based on a new estimated position of the specific user, the new estimated position of the specific user being different from the estimated position of the specific user.

11. The information processing system according to claim 1, wherein the circuitry is configured to select another subset of the plurality of actuators arranged around the specific user to output new signals to the specific user based on a new estimated position of the specific user, the new estimated position of the specific user being different from the estimated position of the specific user.

12. An information processing system comprising:

circuitry configured to:

recognize a given target for communication with a specific user based on signals detected by a plurality of sensors around the specific user by identifying a command within the signals, the given target being separate from the specific user, wherein the specific user is identified by acquiring an ID of a specific user from a tag possessed by the specific user; and generate processed signals to be output from a selected subset of actuators around the specific user based on other signals acquired by other sensors arranged around the given target based on access destination information corresponding to the given target and in response to signals acquired from the specific user by a group of sensors, the group of sensors being sensors selected from the plurality of sensors that are optimal for acquisition of the signals detected by the plurality of sensors based on an estimated position of the specific user, a direction of the specific user and a position of the mouth of the specific user, the group of sensors having super directivity via a delay-and-sum array processing and null generation processing directed at the mouth of the specific user performed thereon after selection, the subset of actuators being selected based on the estimated position of the specific user.

13. A non-transitory computer-readable storage medium including computer-readable instructions that, when executed by a computer, cause the computer to execute a method comprising:

acquiring an ID of a specific user from a tag possessed by the specific user to identify the specific user;

recognizing a given target for communication with the specific user based on signals detected by a plurality of sensors arranged around the specific user by identifying a command within the signals, the given target being separate from the specific user;

estimating a position of the specific user in accordance with the signals detected by any one of the plurality of sensors;

selecting a group of sensors from the plurality of sensors that is optimal for acquisition of the signals detected by the plurality of sensors based on the estimated position of the specific user, a direction of the specific user and a position of the mouth of the specific user;

performing, after selecting the group of sensors, super directivity of the group of sensors via a delay-and-sum array processing and null generation processing directed at the mouth of the specific user;

outputting the signals acquired by the group of sensors to the given target;

identifying access destination information corresponding to the given target for acquiring other signals from the given target based on the recognized given target processing the other signals acquired from another plurality of sensors around the given target in response to the output signals; and selecting a subset of a plurality of actuators arranged around the specific user to output the other signals to the specific user based on the estimated position of the specific user.

14. A non-transitory computer-readable storage medium including computer-readable instructions that, when executed by a computer, cause the computer to execute a method comprising:

recognizing a given target for communication with a specific user based on signals detected by a plurality of sensors around the specific user by identifying a command within the signals, the given target being separate from the specific user, wherein the specific user is identified by acquiring an ID of a specific user from a tag possessed by the specific user; and generating processed signals to be output from a selected subset of actuators around the specific user based on other signals acquired by other sensors arranged around the given target based on access destination information corresponding to the given target and in response to signals acquired from the specific user by a group of sensors, the group of sensors being sensors selected from the plurality of sensors that are optimal for acquisition of the signals detected by the plurality of sensors based on an estimated position of the specific user, a direction of the specific user and a position of the mouth of the specific user, the group of sensors having super directivity via a delay-and-sum array processing and null generation processing directed at the mouth of the specific user performed thereon after selection, the subset of actuators being selected based on the estimated position of the specific user.

* * * * *